US006749499B1

(12) United States Patent
Snyder

(10) Patent No.: US 6,749,499 B1
(45) Date of Patent: Jun. 15, 2004

(54) COVER FOR REGISTER AND REGISTER OPENING

(75) Inventor: Darryl L. Snyder, Canton, OH (US)

(73) Assignee: Snyder National Corporation, Canton, OH (US)

( * ) Notice: Subject to any disclaimer, the term of this patent is extended or adjusted under 35 U.S.C. 154(b) by 0 days.

(21) Appl. No.: 10/387,810

(22) Filed: Mar. 12, 2003

(51) Int. Cl.[7] ..... F24F 7/00

(52) U.S. Cl. ..... 454/289; 454/284; 454/291; 55/385.2

(58) Field of Search ..... 454/289, 284, 454/287, 309, 322; 55/385.2

(56) References Cited

U.S. PATENT DOCUMENTS

| | | | | | |
|---|---|---|---|---|---|
| 1,488,694 | A | * | 4/1924 | Marks | 55/414 |
| 3,232,205 | A | | 2/1966 | Bumstead | |
| 3,589,265 | A | | 6/1971 | Hedrick | |
| 4,502,368 | A | | 3/1985 | Hempel | |
| 4,712,343 | A | | 12/1987 | Dearing et al. | |
| 4,829,886 | A | | 5/1989 | Battaglin | |
| 5,100,445 | A | * | 3/1992 | Johnson et al. | 55/413 |
| 5,180,331 | A | | 1/1993 | Daw et al. | |
| 5,266,091 | A | | 11/1993 | McDonald | |
| 5,597,392 | A | | 1/1997 | Hawkins et al. | |
| 5,720,660 | A | | 2/1998 | Benedetto et al. | |
| 5,947,815 | A | | 9/1999 | Danforth | |
| 6,066,044 | A | | 5/2000 | Orendorff | |
| 6,273,145 | B1 | | 8/2001 | Botting | |
| 6,461,235 | B2 | | 10/2002 | Rutler et al. | |

* cited by examiner

*Primary Examiner*—Derek S. Boles
(74) *Attorney, Agent, or Firm*—Sand & Sebolt

(57) ABSTRACT

A register cover for a register opening in a floor includes a body with a pair of legs extending from and pivoted to the body. Each of the legs may pivot between extended and retracted positions. The legs are adapted to be inserted into the register opening when the legs are in the retracted position. Another register cover is wrapped around a rigid register vent to protect the vent during construction.

20 Claims, 22 Drawing Sheets

COVER FOR REGISTER AND REGISTER OPENING

BACKGROUND OF THE INVENTION

1. Technical Field

The present invention generally relates to the field of heating, ventilation, and air conditioning and, more particularly, to the ducts used in HVAC systems. Specifically, the present invention relates to protective covers that are used at duct openings to protect a register opening or a register cover during construction or remodeling work.

2. Background Information

Heating, ventilation, and air conditioning ducts originate and terminate in floors at register openings. Registers are typically disposed in the register opening to prevent larger things from falling into the duct and to direct the flow of air out of the opening. In new construction, the register openings are cut in the floor before the ducts are installed thus leaving openings in the floor that allow things to fall through the floor. These openings are dangerous and undesirable. The openings create an injury risk because a worker can step through an opening. The openings are undesirable because they allow debris to fall down from one room to another. One example is when the concrete basement floor is poured and not yet cured. Uncovered register openings allow dust and debris to fall down onto the uncured basement floor. One solution to these openings is to simply install the metal register in the opening as soon as the opening is cut. A drawback to this solution is that the register can be damaged during continuing work on the room having the registers. Another drawback is that the registers can be lost. The art thus desires an inexpensive disposable cover that can be used to temporarily cover the register openings until the registers are ready to be permanently installed in the openings.

BRIEF SUMMARY OF THE INVENTION

In one embodiment, the invention provides a register cover for a register opening in a floor. The register cover including a body having an upper side and a lower side; a pair of legs pivotally connected to the body; each of the legs extending from the lower side of the body; each of the legs pivoting between extended and retracted positions; and the legs being adapted to be inserted into the register opening when the legs are in the retracted position.

In another embodiment, the invention provides a protective register vent cover. The cover includes an upper layer and a lower layer connected together with a living hinge with the lower layer defining a body opening. The upper layer of the cover is hinged to the lower layer with a living hinge. The upper and lower layers are connected opposite the living hinge. The cover may thus receive a register vent between the layers with the body of the vent extending through an opening defined by one of the layers.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
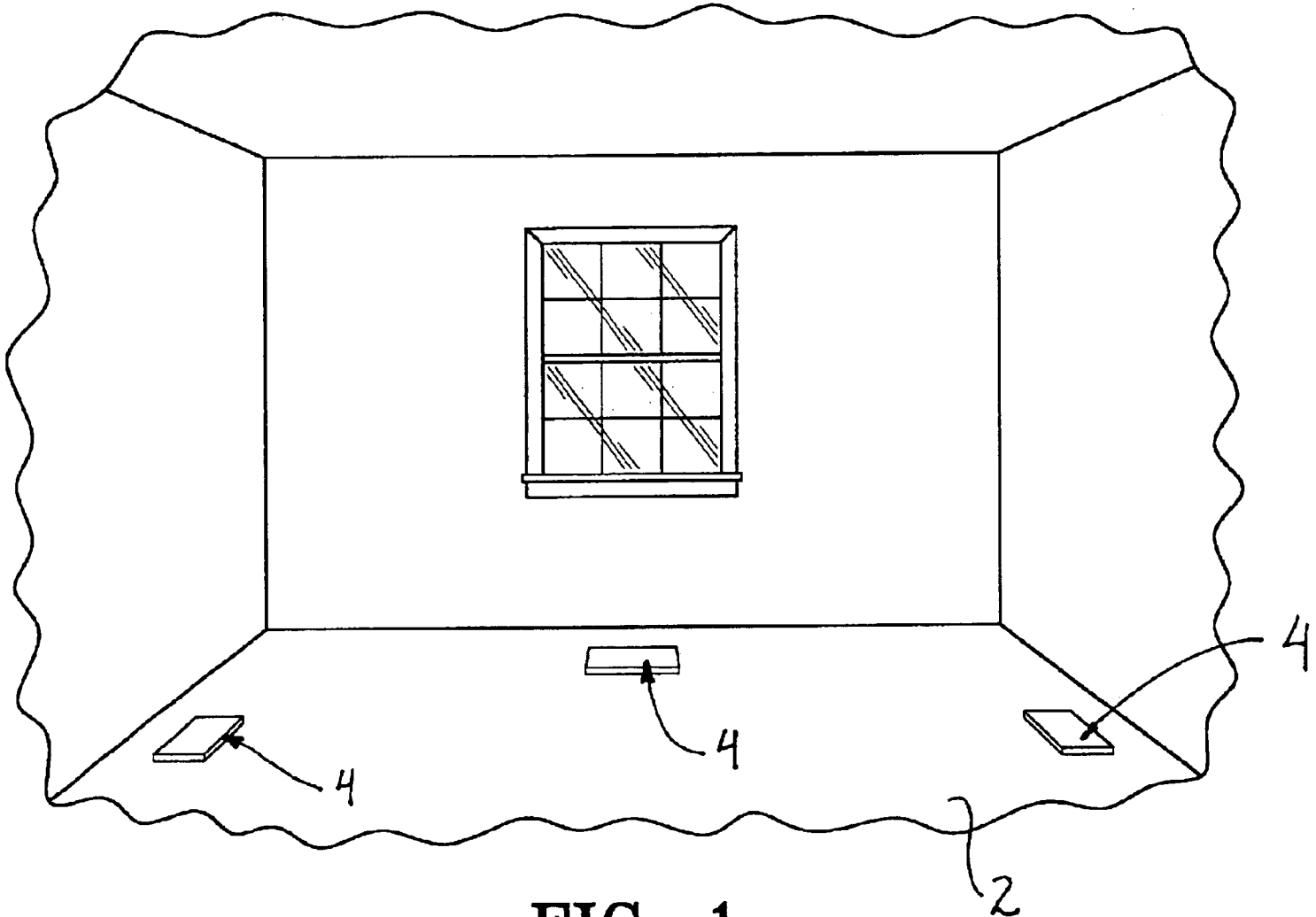
FIG. 1 is a perspective view of a room having three register openings covered with the register covers of the present invention.

FIG. 1 depicts a typical room having three register openings in a floor 2. In FIG. 1, each of the register openings is covered with a register cover 4 made in accordance with the concepts of the present invention. Register covers 4 are used to prevent dust and debris from falling through the register openings and to somewhat protect workers by identifying the locations of the register openings. Register covers 4 may identify the location of the openings by being provided in a bright color such as red, yellow, or orange.

FIGS. 2–9 depict a first embodiment of the body 6 of register cover 4. Body 6 includes an upper layer 8 and a lower layer 10 that are connected together with a hinge 12 that may be in the form of a living hinge. Upper layer 8 defines an upper side of body 6 while lower layer 10 defines a lower side of body 6. Body 6 has a length (running in the horizontal direction on the page showing FIG. 2) and a width (running in the vertical direction on the page of FIG. 2) that are larger than the length and width of the register opening such that body 6 will completely cover the register opening as depicted in FIG. 1.

Figure 2:
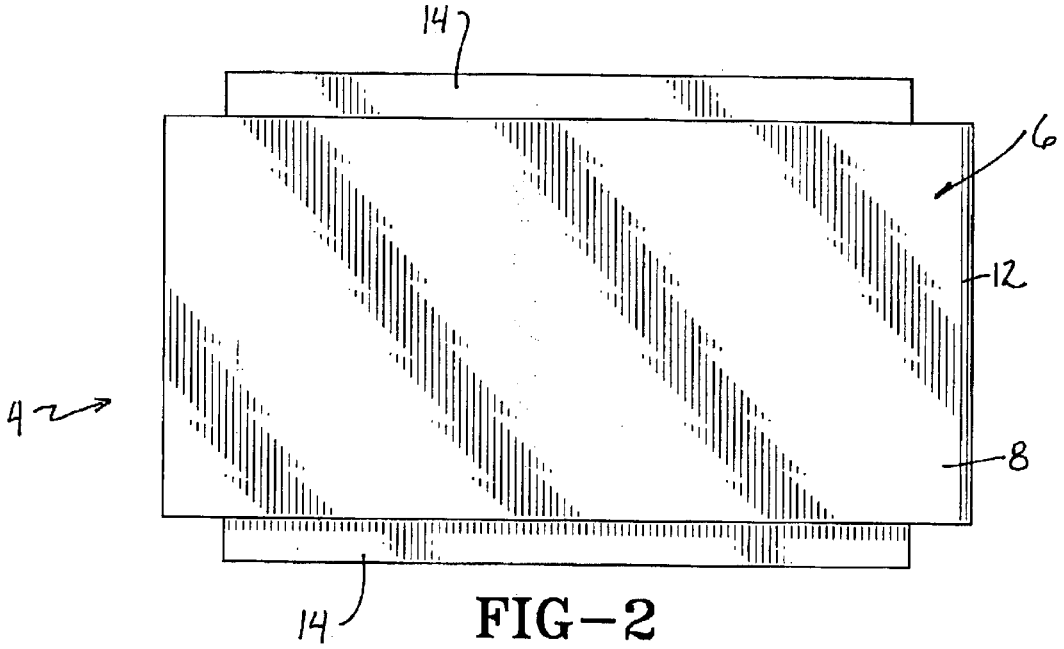
FIG. 2 is a top plan view of a first embodiment of the register opening cover of the present invention.
Figure 3:
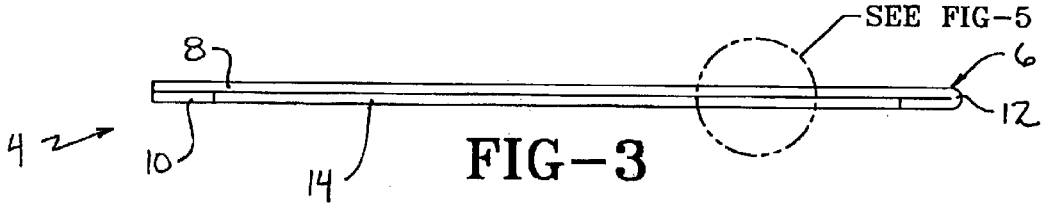
FIG. 3 is a side elevation view of FIG. 2.
Figure 4:
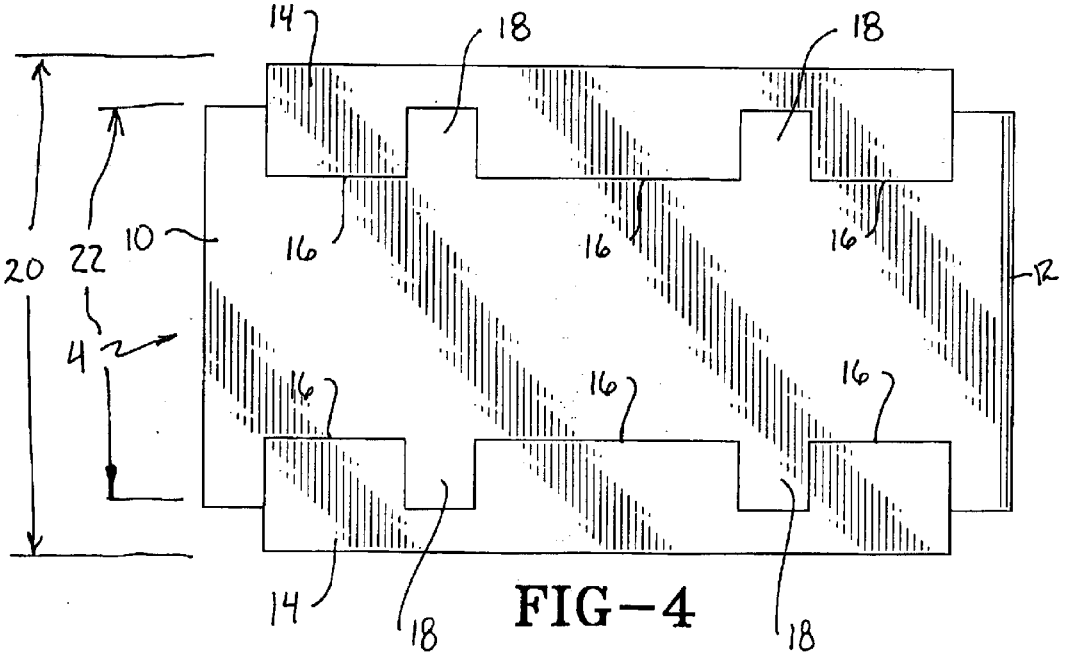
FIG. 4 is a bottom plan view of FIG. 2.
Figure 5:
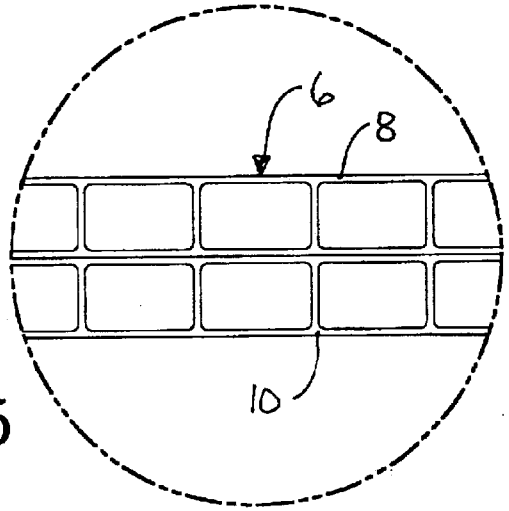
FIG. 5 is an enlarged view of the encircled portion of FIG. 3.

Register cover 4 is held in place with a pair of legs 14 that extend from the lower side of body 6. Each of legs 14 is pivotly attached to body 6 so that the legs may be pivoted between extended and retracted positions. The fully extended positions of legs 14 are shown in FIGS. 2 and 4 with the retracted position being shown in FIGS. 6, 7, and 9. Legs 14 are biased from the retracted position toward the extended position by the memory inherent in body 6. The bias in force is created by hingedly connecting legs 14 to lower layer 10 with living hinges 16. Living hinges 16 may be continuous or in the form of a plurality of spaced living hinges as shown in FIG. 4. When spaced living hinges 16 are used, strengthening ribs 18 are provided between hinges 16.

Figure 9:
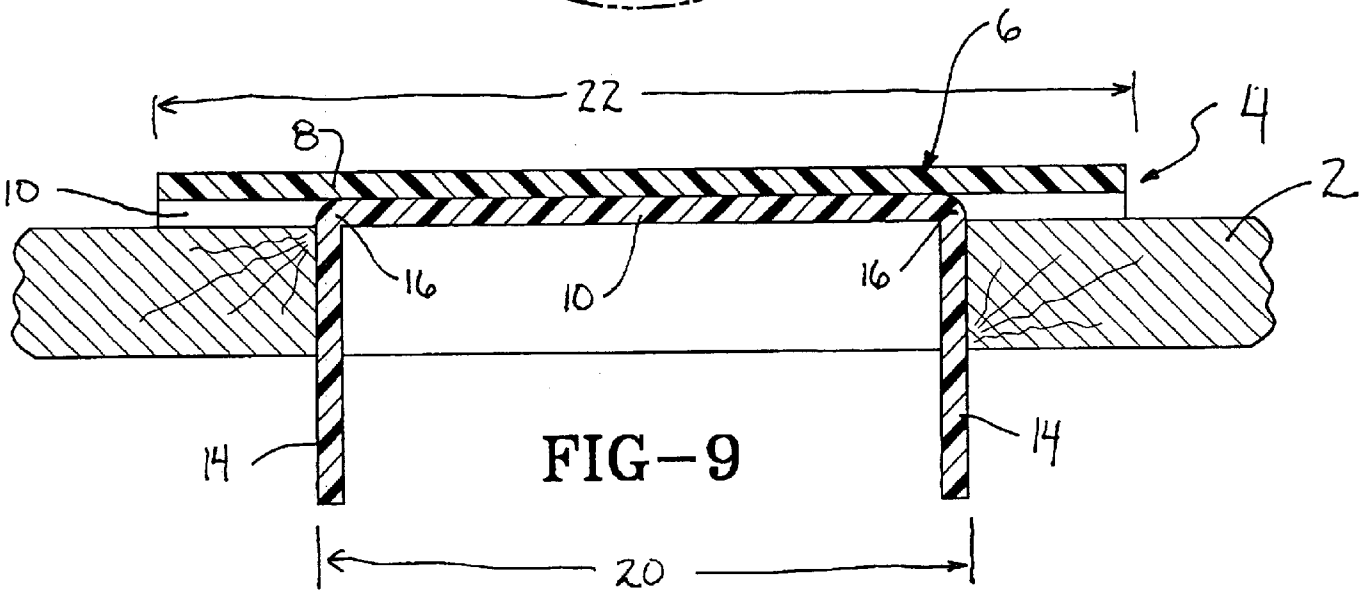
FIG. 9 is a section view taken along line 9—9 of FIG. 8.

The distance between the outer ends of legs 14 is greater than the width of upper layer 8 as indicated by the numerals 20 and 22 in FIG. 4. Furthermore, the distance between the outer ends of legs 14 is greatest in the fully extended position as shown in FIG. 4 and smallest in the fully retracted position. In the retracted position, the distance between the outer ends of legs 14 is less than width 22 as shown in FIG. 9.

Upper layer 8 and lower layer 10 of body 6 may be fabricated from a corrugated material. The corrugated material may be a corrugated polymer material with the corrugations running parallel to the width dimension of body 6 in order to increase the strength of register cover 4. Upper layer 8 may be connected to lower layer 10 with any of a variety of known connectors such as adhesives, mechanical connectors like staples.

Figure 6:
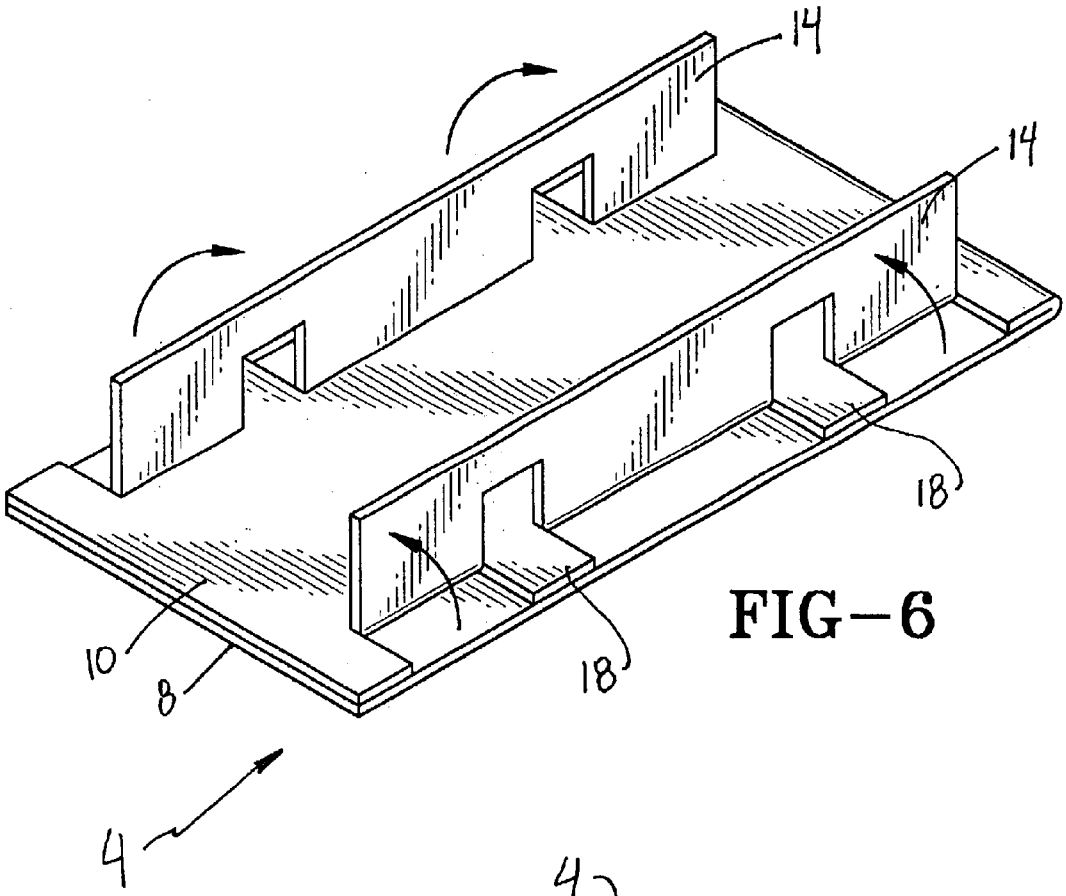
FIG. 6 is a perspective view of the bottom of the first embodiment of the register opening cover with the legs being folded out from their first position to their second position.
Figure 13:
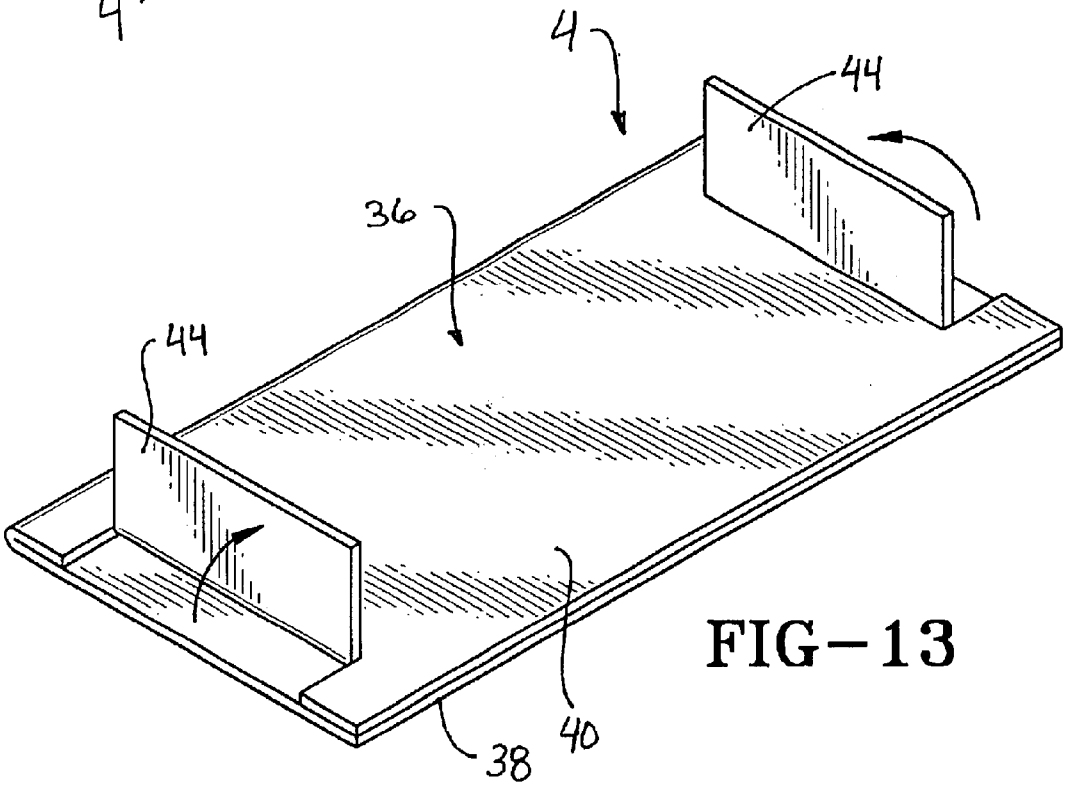
FIG. 13 is a perspective view of the bottom of the second embodiment of the register opening cover with the legs being folded out from their first position to their second position.
Figure 7:
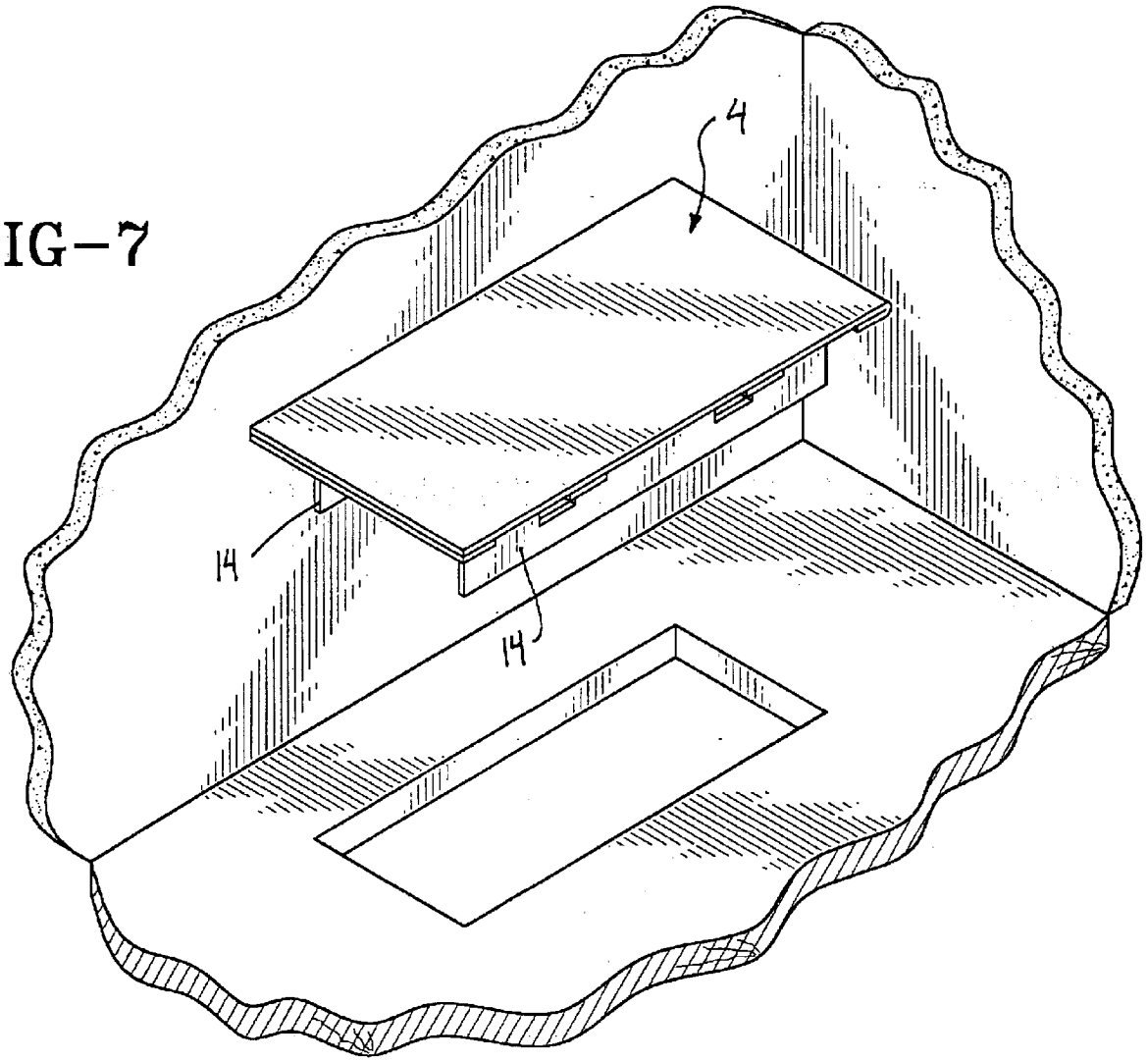
FIG. 7 is a perspective view showing the first embodiment of the register opening cover with the legs in the second position aligned with a register opening.
Figure 8:
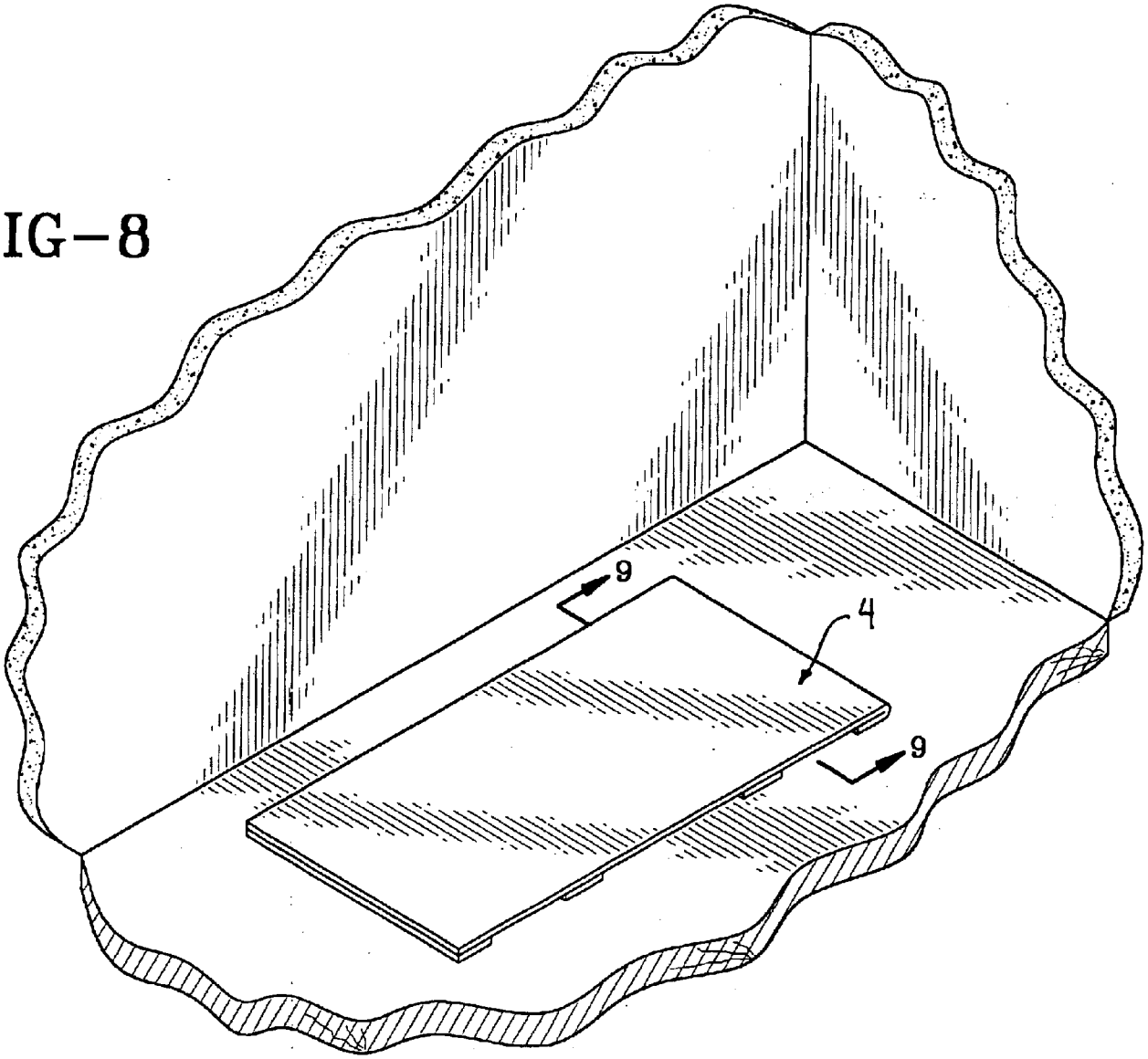
FIG. 8 is a perspective view showing the first embodiment of the register opening cover disposed in the register opening.
Figure 10:
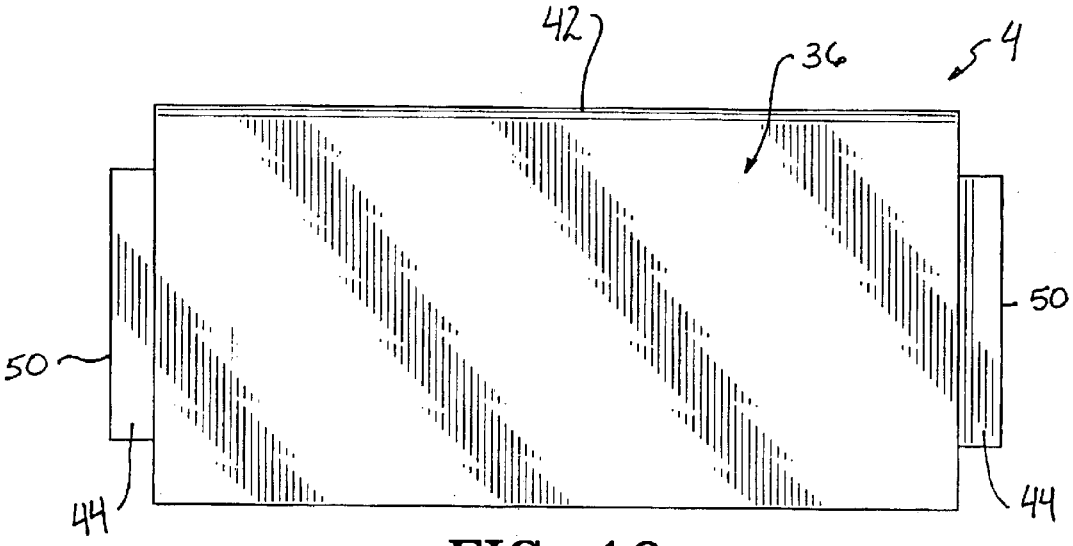
FIG. 10 is a top plan view of a second embodiment of the register opening cover of the present invention.
Figure 11:
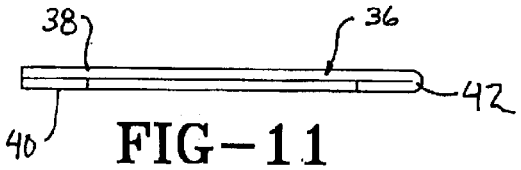
FIG. 11 is a end elevation view of FIG. 10.

FIG. 6 shows legs 14 being moved from the extended position to the retracted position. FIG. 6 also more clearly shows the structure of strengthening ribs 18. In FIG. 7, register cover 4 is aligned with the opening with legs 14 in the retracted positions. In FIG. 8, register cover 4 has been installed into register opening with FIG. 9 showing legs 14 being biased against the edges of floor 2 that define the register opening. In FIG. 9, hinges 16 have been configured to be spaced apart the same width as the register opening. In other embodiments, hinges 16 may be spaced apart smaller than the width of the opening such that legs 14 are angled outwardly when register cover 4 is installed.

The second embodiment of a body for register cover 4 is depicted in FIGS. 10–16 and indicated generally by the numeral 36. Body 36 also has an upper layer 38 and a lower layer 40 that define the upper side and lower side of body 36. Upper layer 38 is connected to lower layer 40 with a hinge 42 that may be in the form of a living hinge. Body 36 has a length and a width that are adapted to be larger than the length and width of the register opening for which cover 4 is intended to be used.

Body 36 includes a pair of legs 44 that are pivotly attached to the lower side of body 36. Each leg 44 is moveable between an extended position (shown in FIG. 12) to a retracted position (shown in FIG. 13). In the second embodiment of body 36, each leg 44 is integrally formed with lower layer 40 and is connected to lower layer 40 with a living hinge 46. As described above, living hinges 46 may be continuous or spaced to form strengthening ribs as required. FIG. 12A shows an alternative structure for legs 44 wherein the edges of legs 44 are crenulated as indicated by the numeral 48. Crenulated edges 48 are adapted to engage the edge of floor 2 that defines the register opening to provide a gripping force to register cover 4.

Figure 12:
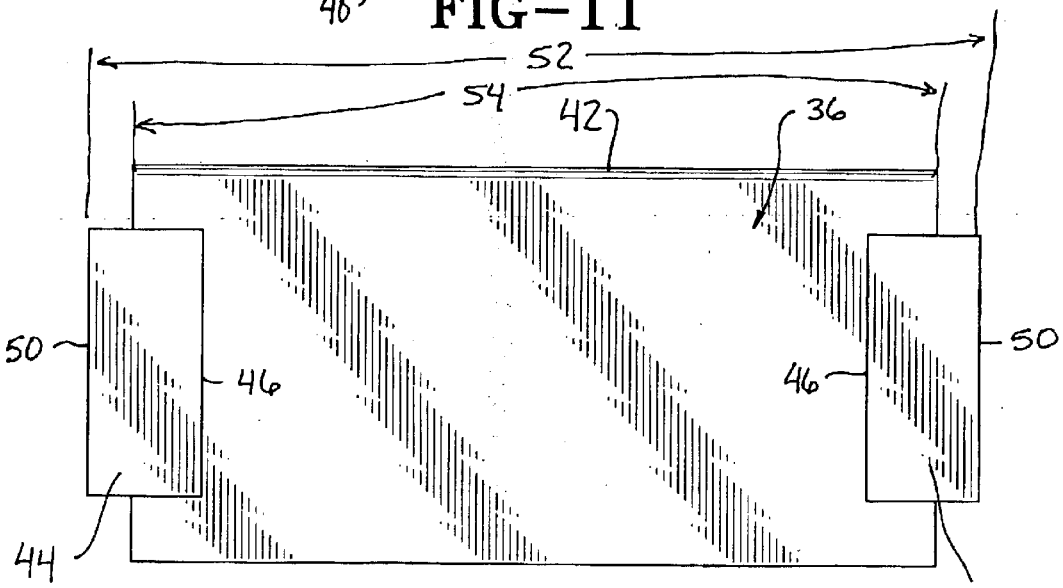
FIG. 12 is a bottom plan view of FIG. 10.
Figure 12A:
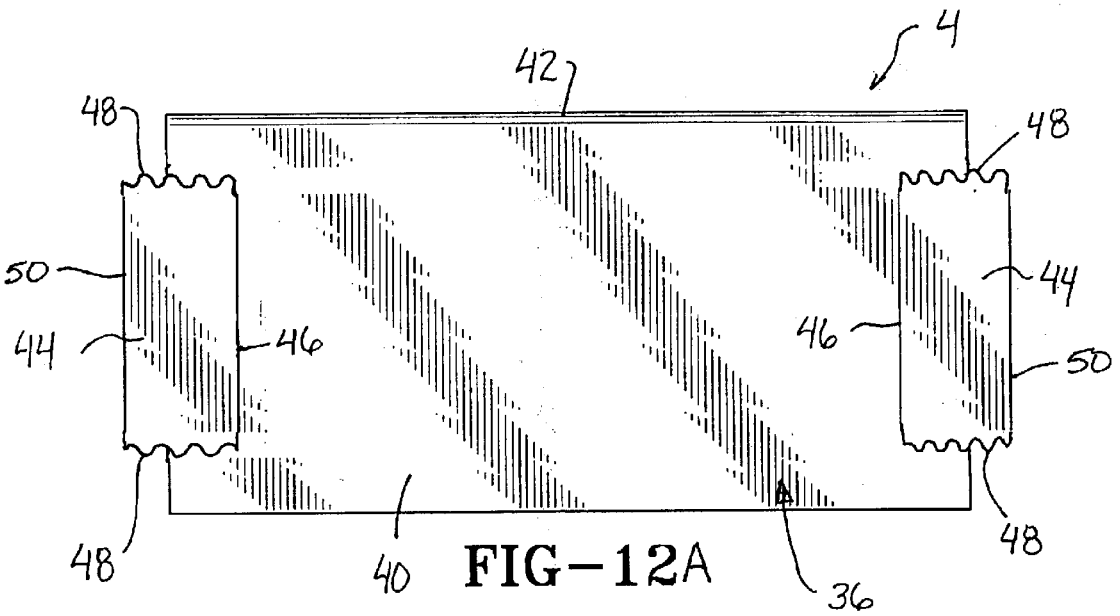
FIG. 12A is a bottom plan view of an alternative embodiment showing alternative leg features.
Figure 12B:
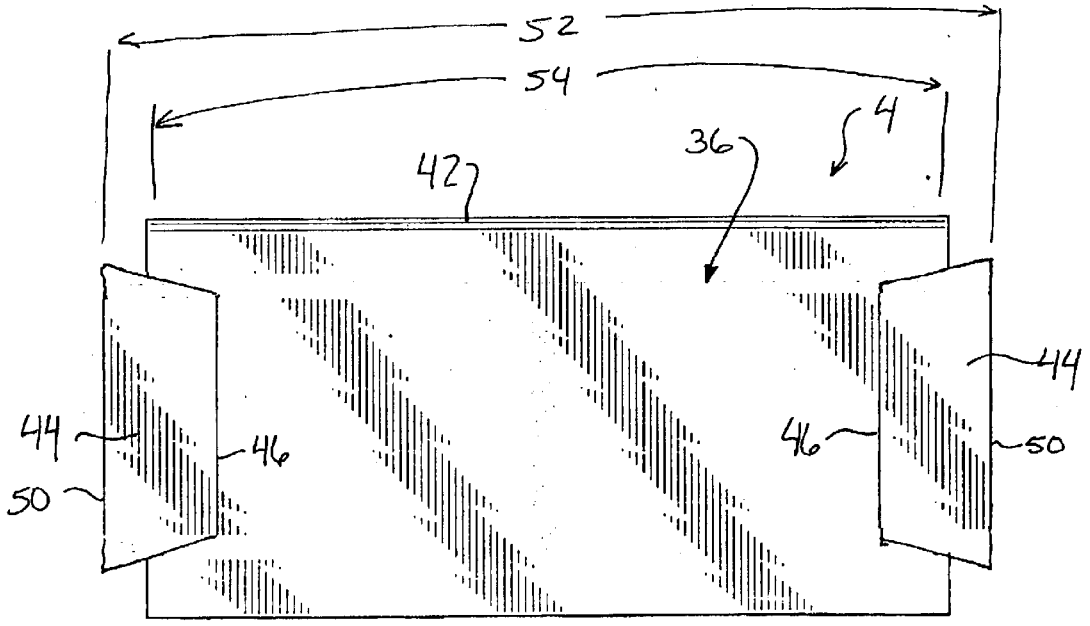
FIG. 12B is a bottom plan view of an alternative embodiment showing alternative leg features.

Another alternative embodiment is depicted in FIG. 12B wherein each leg 44 is wedge-shaped such that the outer end 50 of leg 44 has a width greater than the total length of hinge 46. The width of outer end 50 may be greater than the width of the register opening such that legs 44 must be forced into the register opening. When this occurs, the material that defines legs 44 will resiliently move back into shape (at least somewhat back into shape) to wedge register cover 4 in place.

Figure 16:
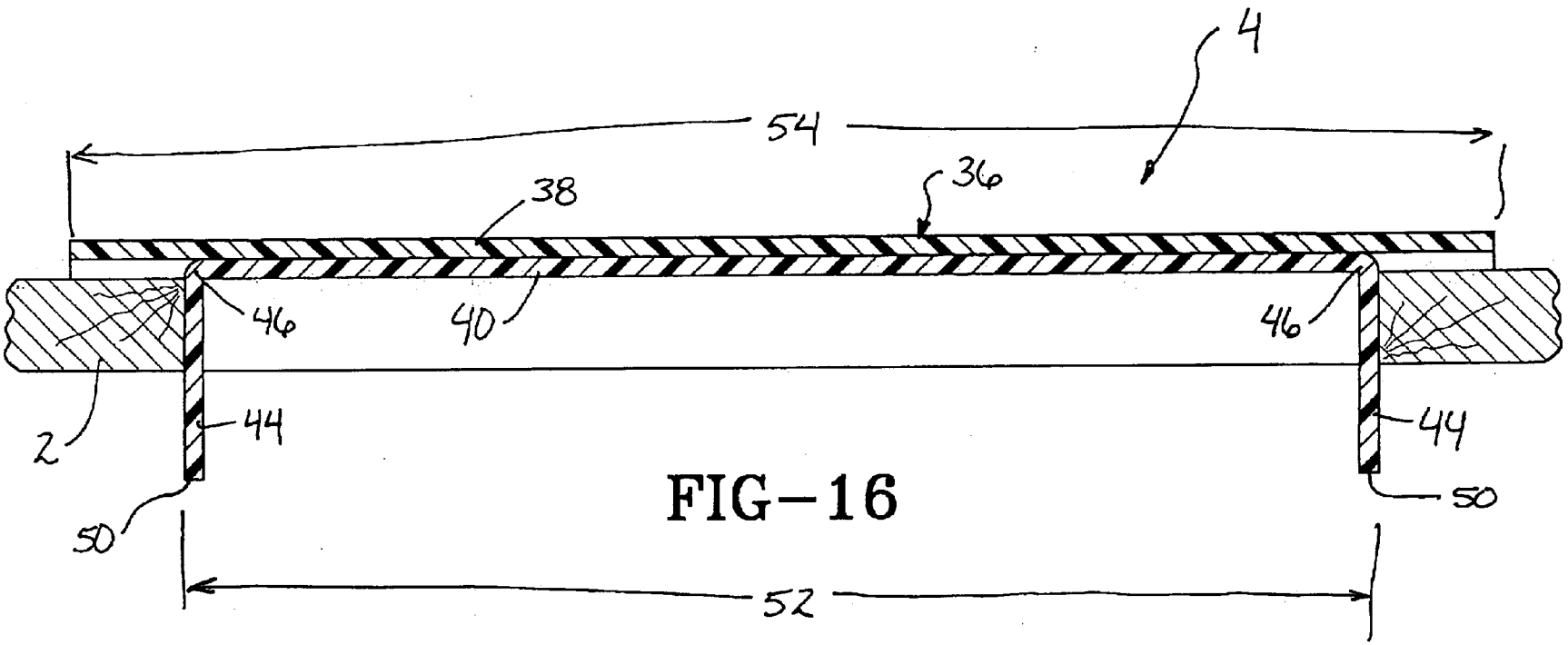
FIG. 16 is a section view taken along line 16—16 of FIG. 15.
Figure 17:
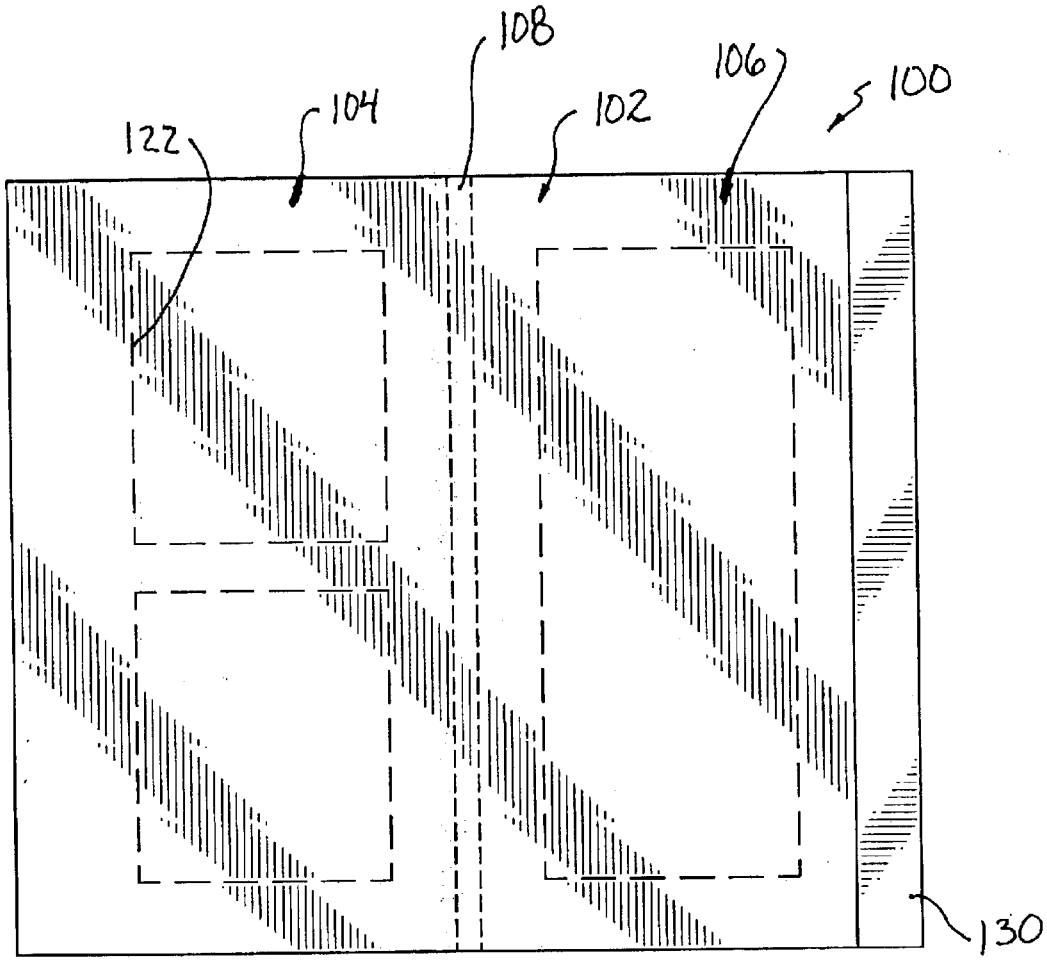
FIG. 17 is a top plan view of a third embodiment of the register opening cover of the present invention when the cover is in an unfolded condition.
Figure 18:
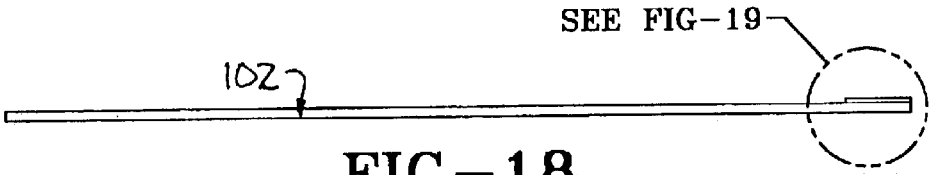
FIG. 18 is a side elevation view of FIG. 17.

In general, the distance 52 between the outer ends of opposite legs 44 is greater than the length 54 of upper layer 38 when legs 44 are in the extended position as depicted in FIG. 12. Distance 52 is less than distance 54 when legs are retracted as depicted in FIG. 16.

Body 36 may also be fabricated from a corrugated material with the corrugations running in the width direction. The corrugated material may be a corrugated polymer. Upper layer 38 may be connected to lower layer 40 with any of a variety of connectors including adhesives and mechanical connectors such as staples.

Figure 14:
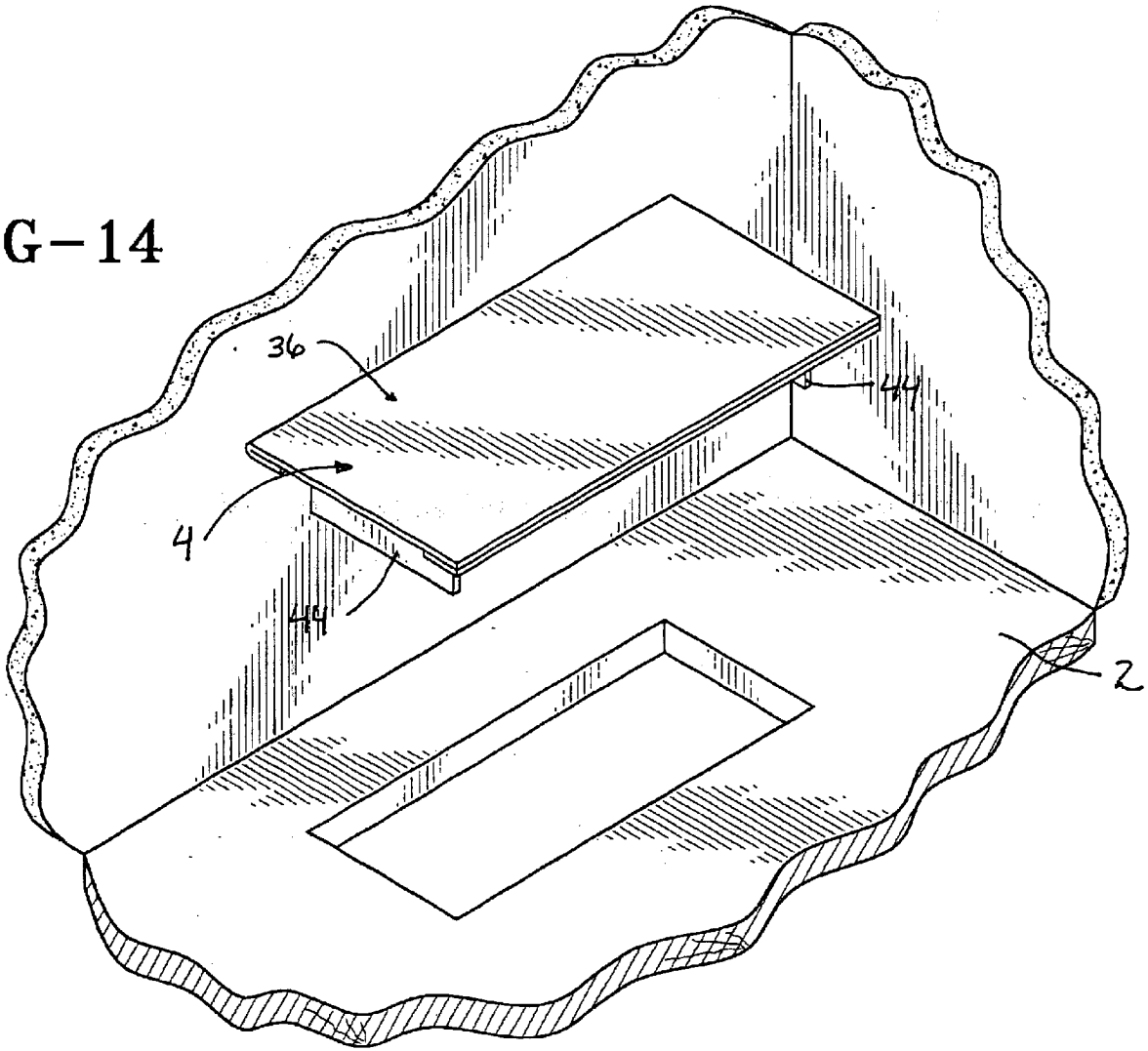
FIG. 14 is a perspective view showing the second embodiment of the register opening cover with the legs in the second position aligned with a register opening.
Figure 15:
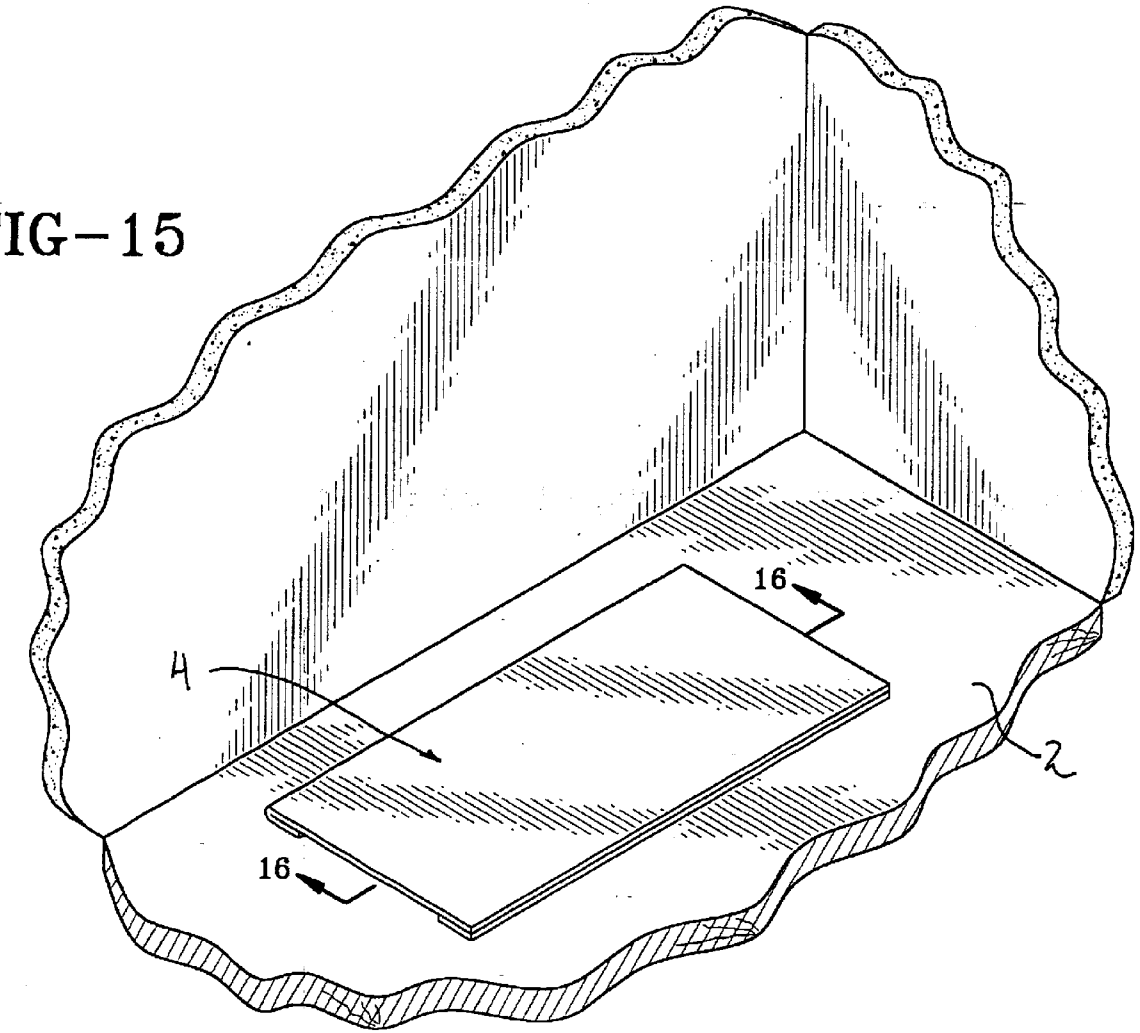
FIG. 15 is a perspective view showing the second embodiment of the register opening cover disposed in the register opening.

The second embodiment of register cover 4 is shown with legs 44 retracted in position with a register opening in FIG. 14. The user then places register cover 4 against floor 2 as depicted in FIG. 15 with legs 44 positioned in the register opening such that legs 44 are biased against floor 2 as depicted in FIG. 16.

A third embodiment of a register cover is depicted in FIGS. 17–27 and is indicated generally by the numeral 100. Cover 100 generally includes a body 102 having an upper layer 104 connected to a lower layer 106 with a hinge 108. Hinge 108 may be a living hinge or a pair of spaced living hinges to provide the necessary thickness to wrap around the flange of the register vent as described below.

Vent cover 100 is used with a register vent 110 to protect register vent 110 during construction. Register vent 110 is known in the art and generally includes a tubular body 112 that extends down from a flange 114. The width and length of flange 114 is greater than the register vent opening that receives body 112. Register vent 110 may include a plurality of louvers 116 that allow vent 110 to be closed. Register vents 110 are typically disposed in register opening formed in the floor 118 of a structure.

Figure 20:
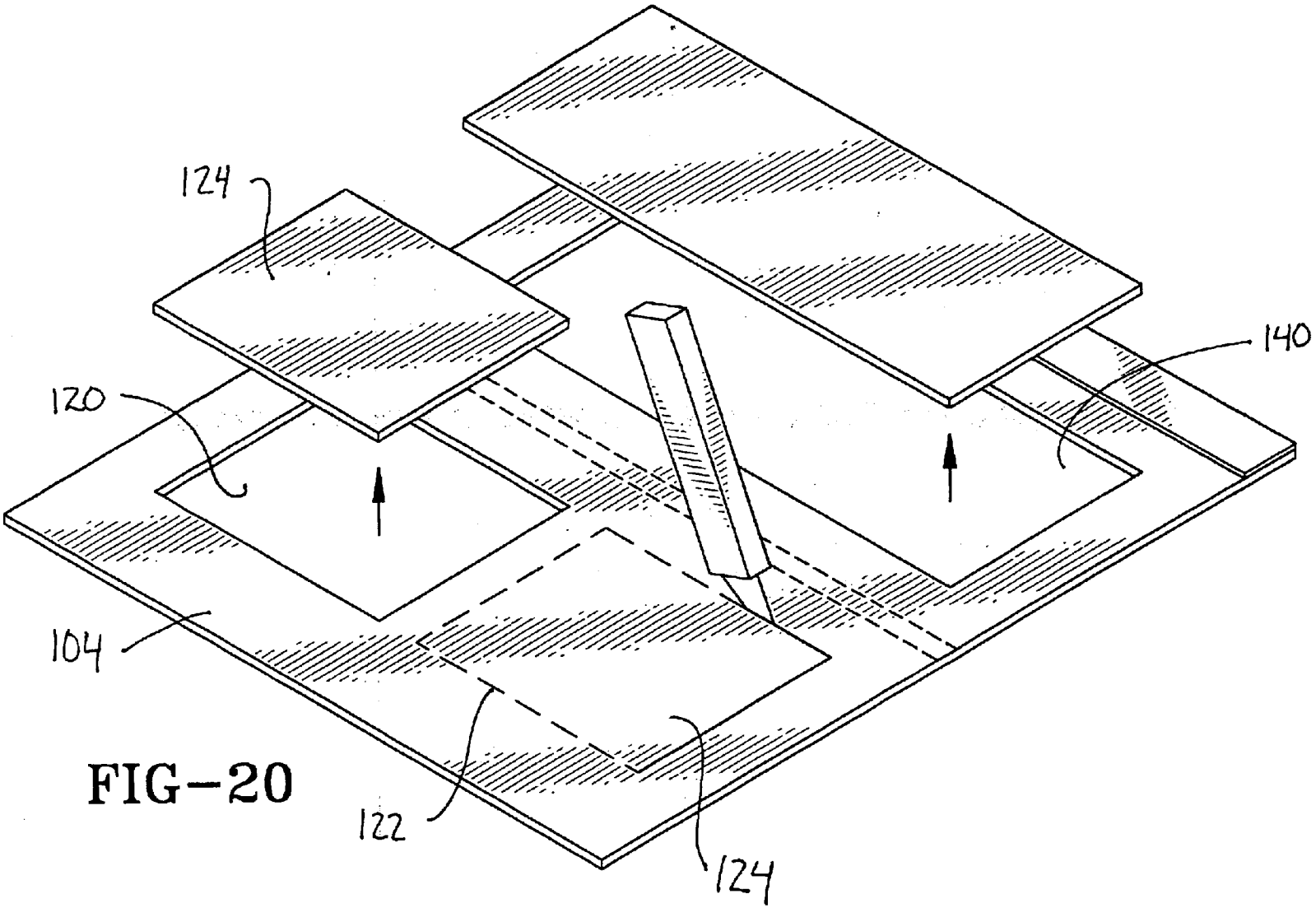
FIG. 20 is a perspective view of the third embodiment of the register opening cover in an unfolded condition showing the openings of the cover being removed with a knife.
Figure 23:
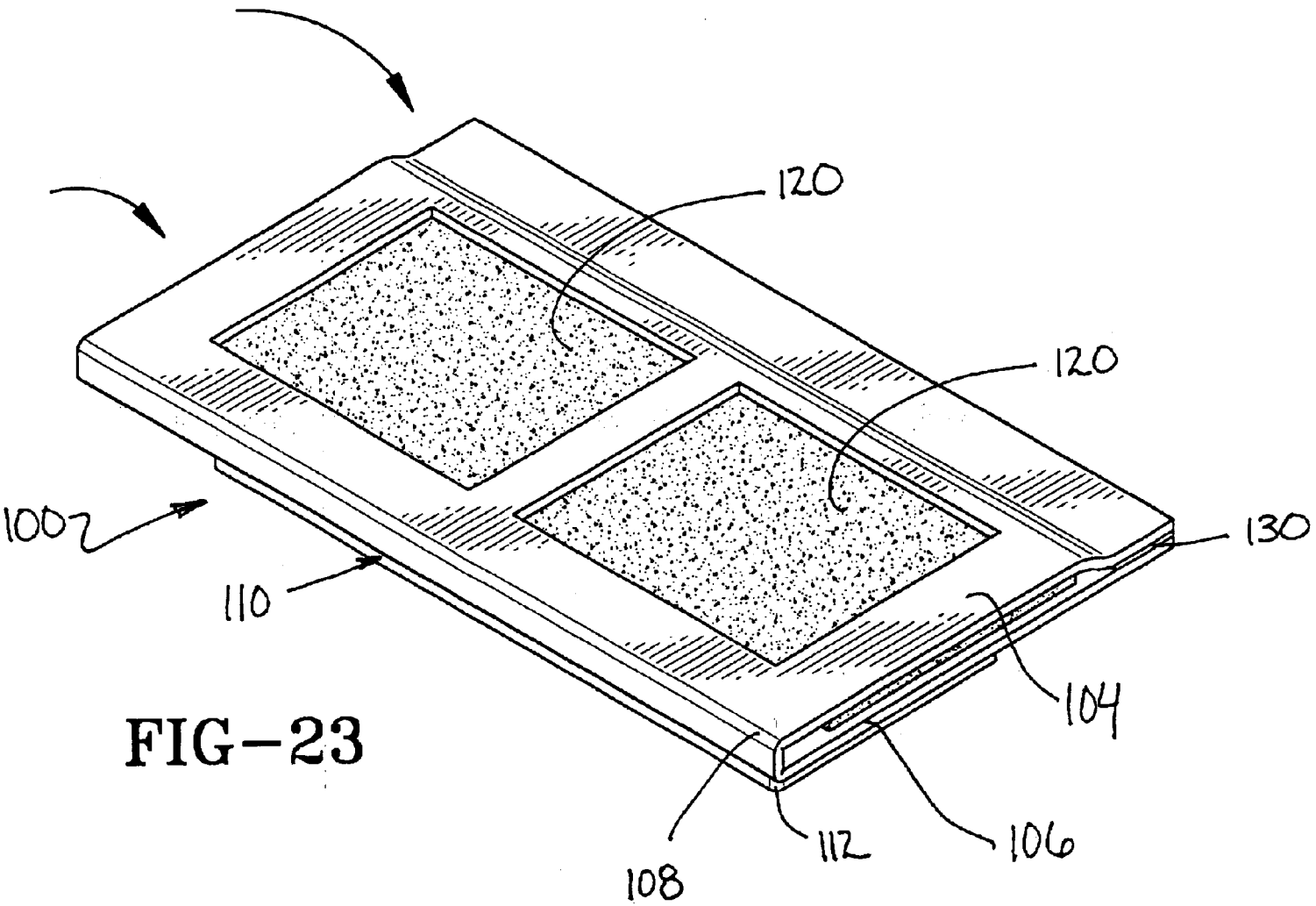
FIG. 23 is a perspective view showing the lid of the third embodiment of the register opening cover being folder over the register and held closed with the tape.

The length and width of upper layer 104 are greater than the length and width of flange 114 such that upper layer 104 completely covers flange 114 as depicted in FIG. 23. Upper layer may define a plurality of openings 120 that allow air to flow through upper layer 104 when vent cover 100 is in use. Openings 120 may be formed before vent cover is sold to the end user. In another embodiment, lines 122 are drawn on one surface of upper layer 104. The end user cuts along lines 122 to form openings 120 as depicted in FIG. 20. In another embodiment, lines 122 are perforated so that the user may simply tear inner portions 124 out of upper layer 104 without the use of a cutting tool. When openings 120 are formed in upper layer 104, the end user may desire to install a filter 126 between flange 114 and upper layer 104 to prevent debris from falling down into register vent 110. Filter 126 may be placed loosely on the upper surface of flange 114 so that it is trapped between the inner surface of upper layer 104 and flange 114 when cover 100 is installed as depicted in FIG. 23.

Figure 19:
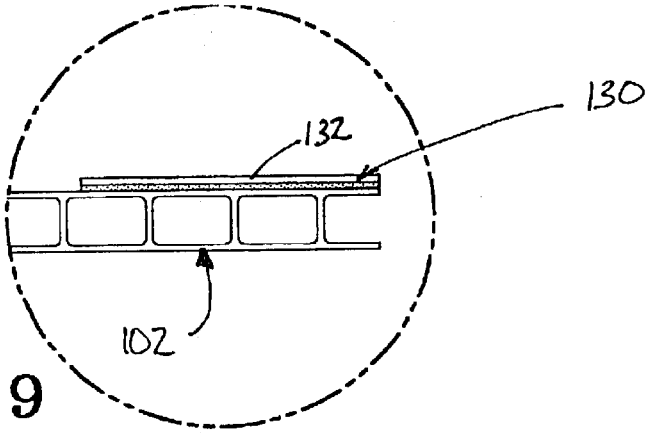
FIG. 19 is an enlarged view of the encircled portion of FIG. 18.

Body 102 may be fabricated from a corrugated material as depicted in FIG. 19. The corrugated material may be a corrugated polymer. The corrugations may run in the length direction of layers 104 and 106 so that living hinge 108 may be easily formed.

Figure 22:
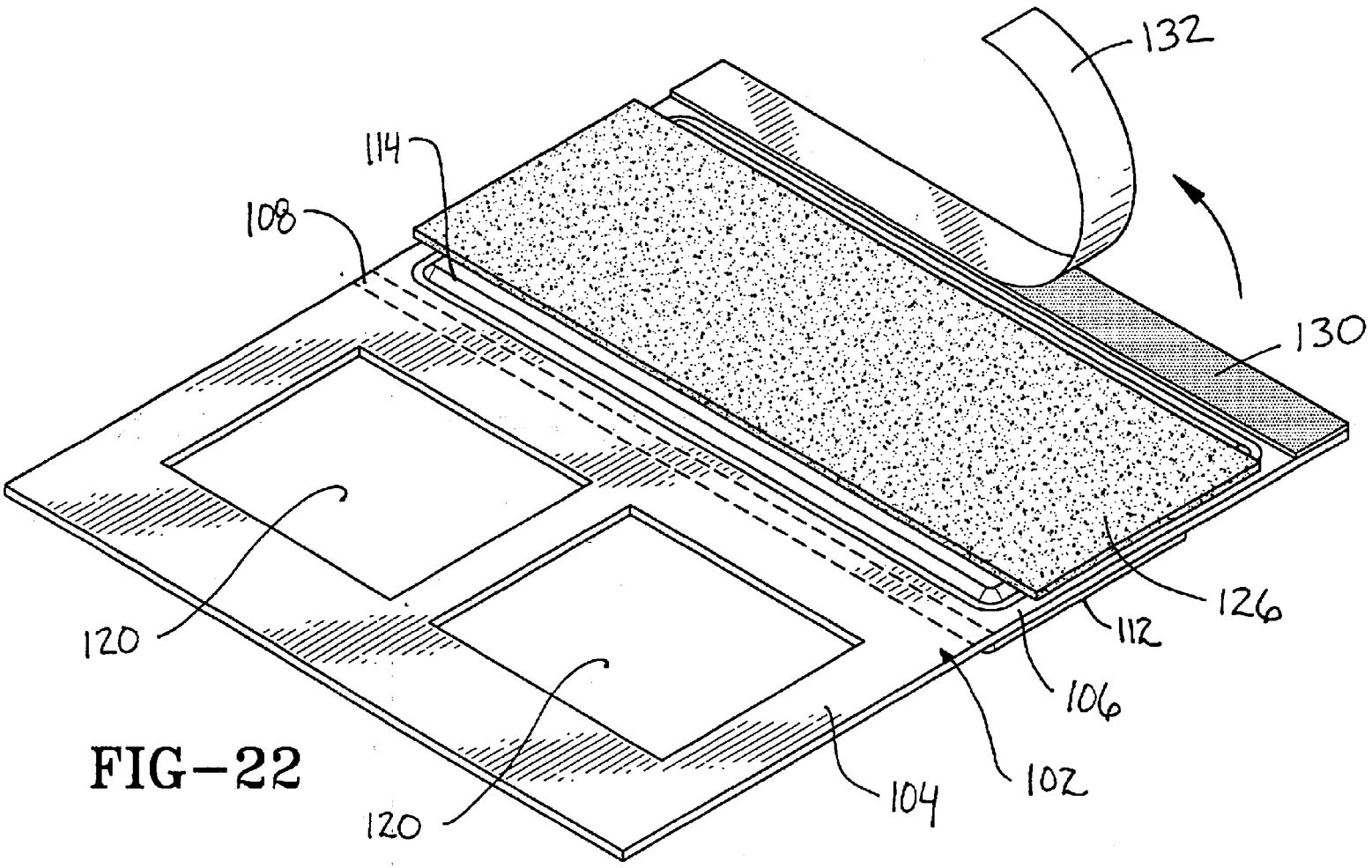
FIG. 22 is a perspective view showing the register inserted into the opening of the base of the third embodiment of the register opening cover, the filter material placed over the register, and the taper cover being peeled from the tape.

A connector 130 may be provided along the lengthwise edge of lower layer 106 opposite hinge 108. Connector 130 may be an adhesive strip with a cover 132 that protects adhesive until cover 100 is ready to be used. FIG. 22 shows cover 132 being removed to expose adhesive 130. Adhesive 130 is used to hold upper layer 104 in the closed position as depicted in FIG. 23.

Lower layer 106 defines a body opening 140 adapted to snugly or frictionally receive body 112 of vent 110 as depicted in FIG. 22. As described, body opening 140 may be defined before cover 100 is sold to the end user or may defined by appropriate lines or perforations that allow body opening 140 to be formed by the user prior to installation.

Figure 21:
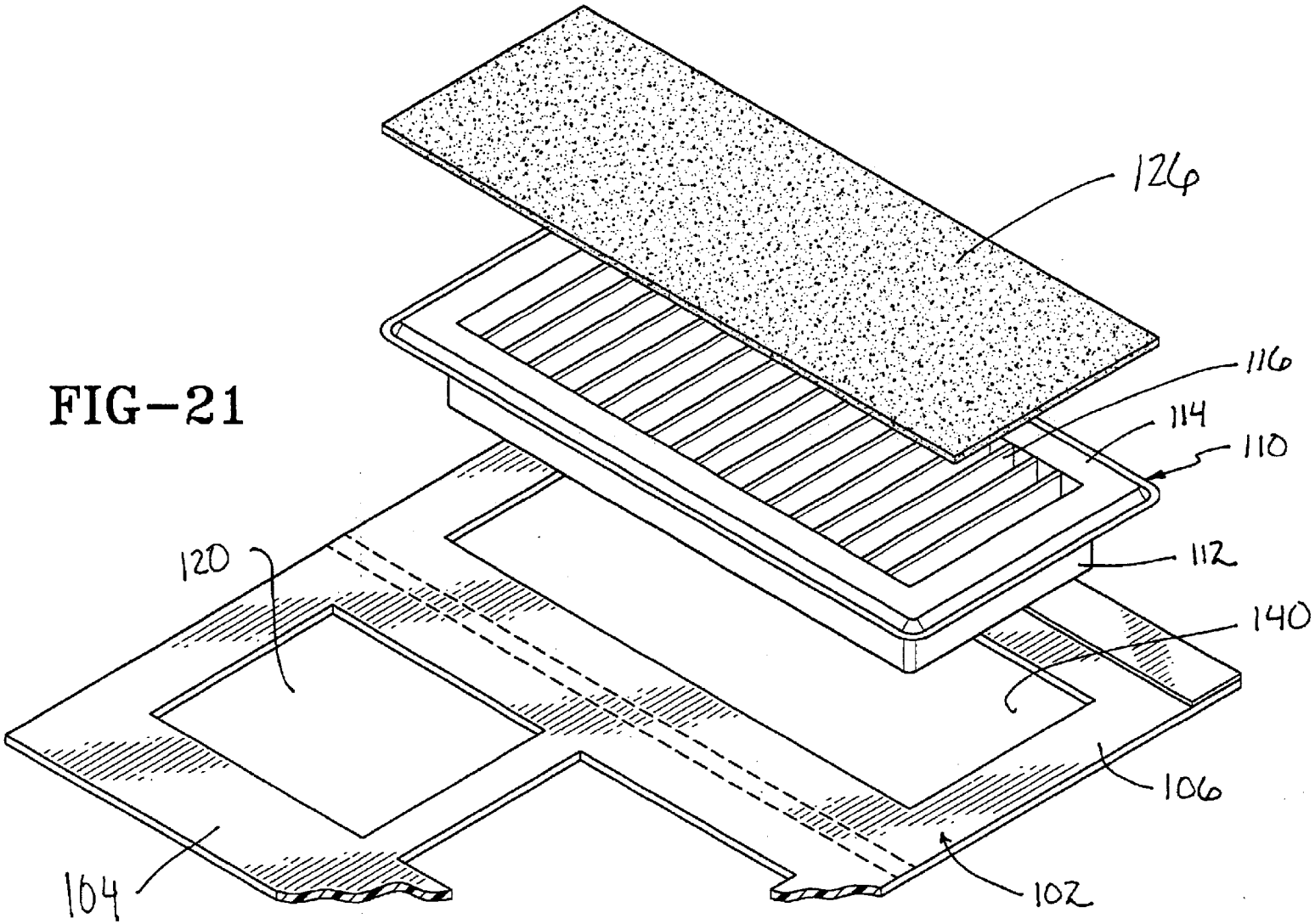
FIG. 21 is a perspective view showing the third embodiment of the register opening cover aligned with a register.
Figure 24:
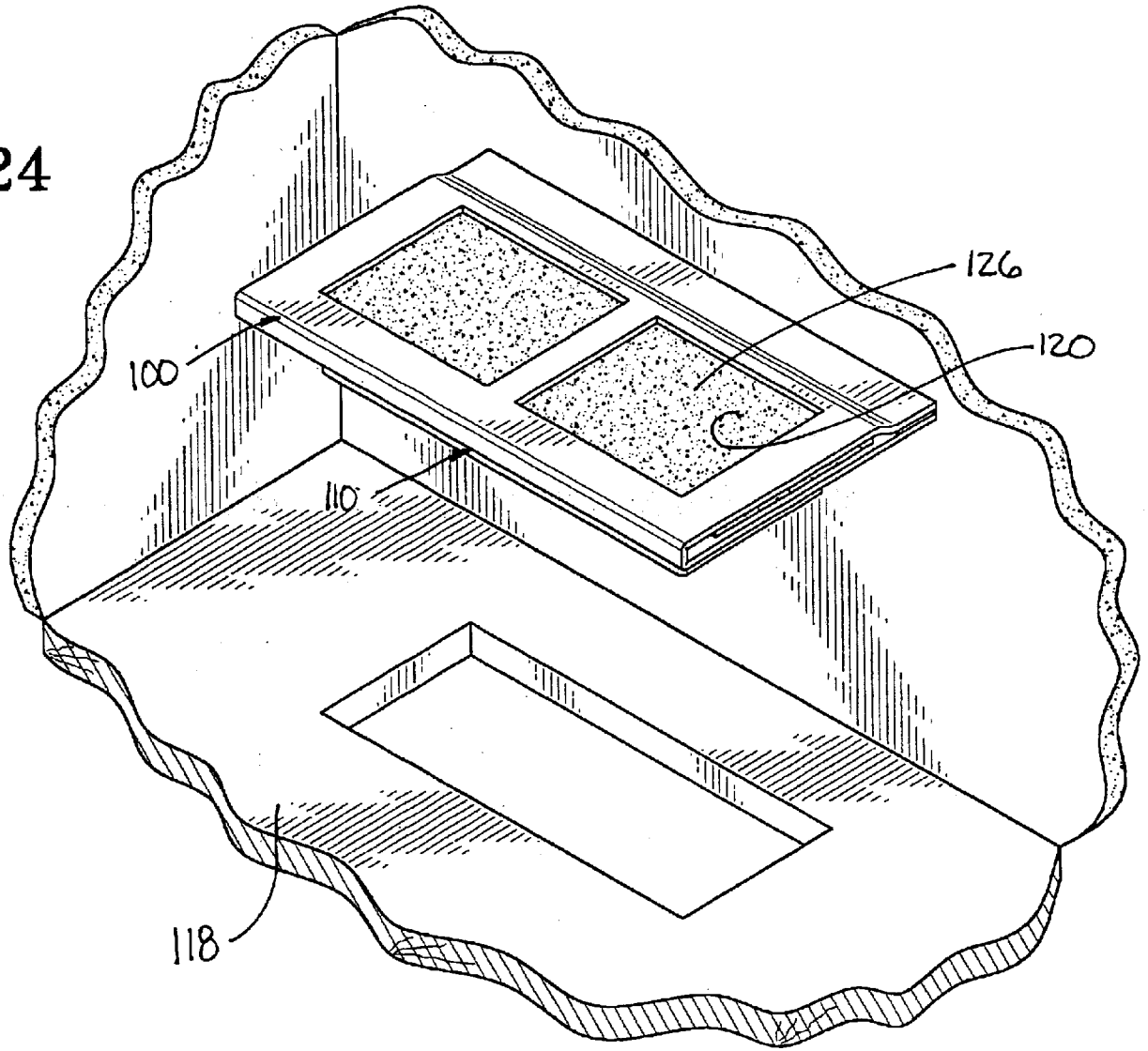
FIG. 24 is a perspective view showing the third embodiment of the register opening cover and register aligned with a register opening.
Figure 25:
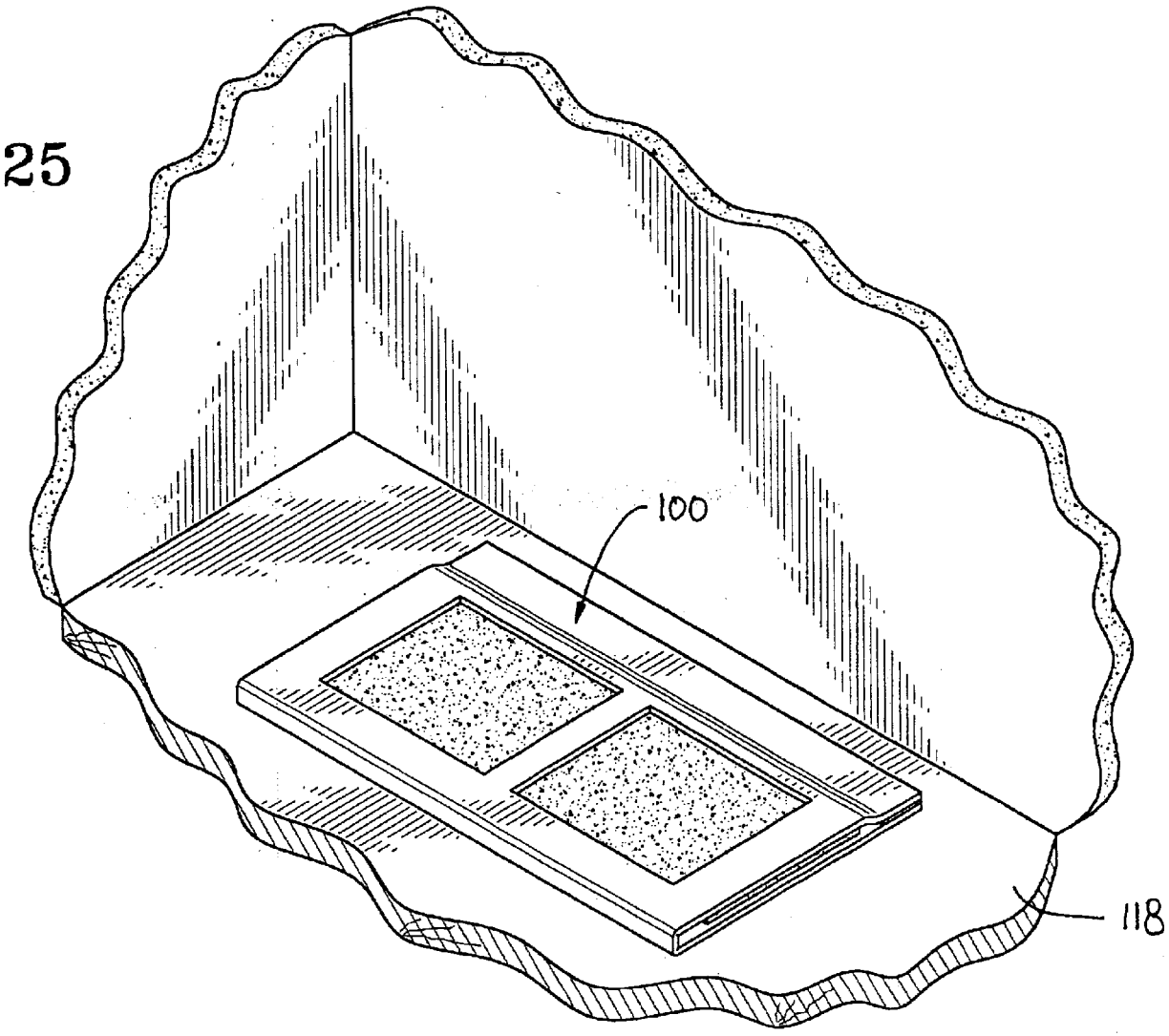
FIG. 25 is a perspective view showing the third embodiment of the register opening cover disposed in the register opening.
Figure 26:
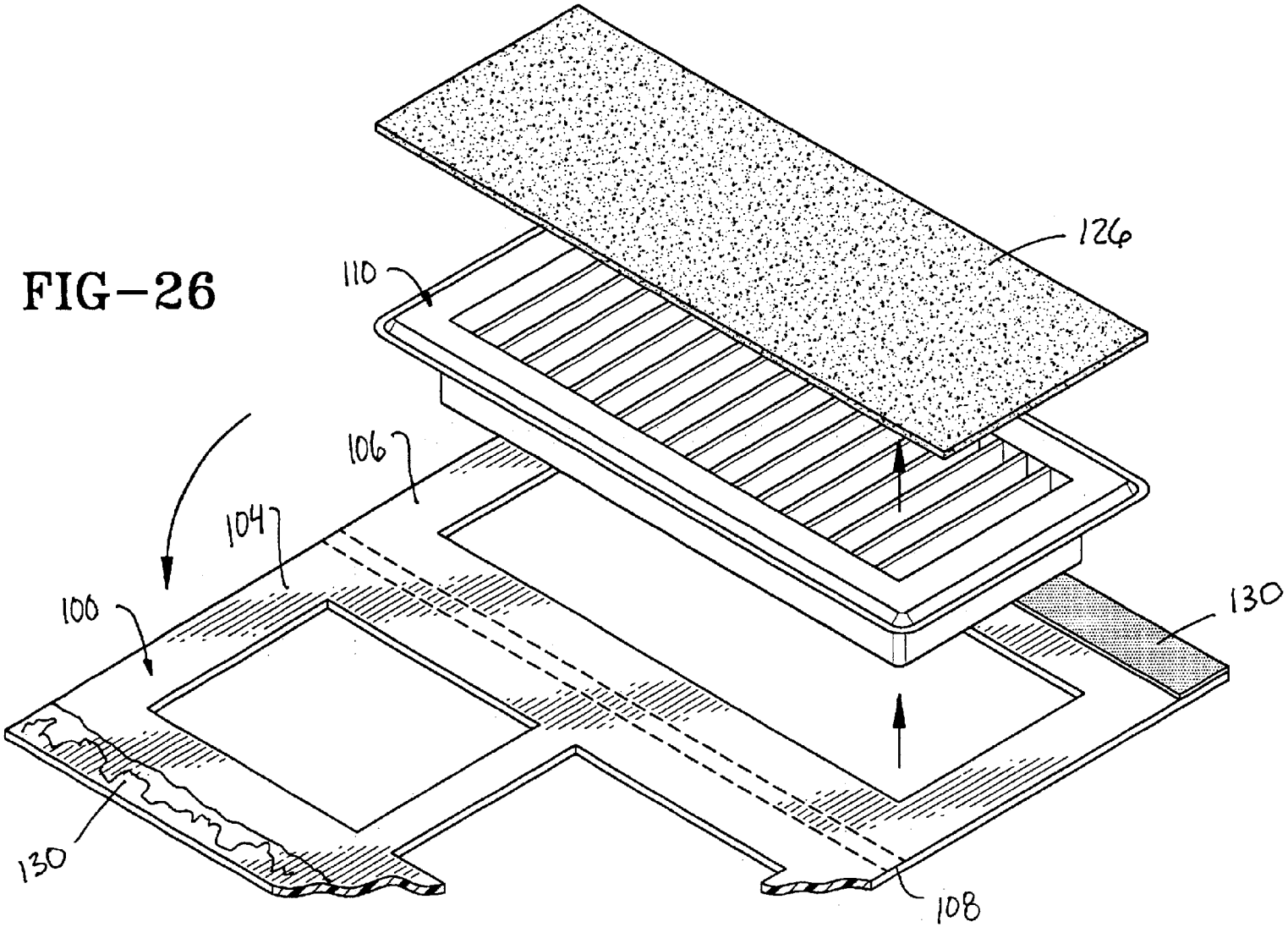
FIG. 26 is a perspective view showing the register being removed from the third embodiment of the register opening cover.
Figure 27:
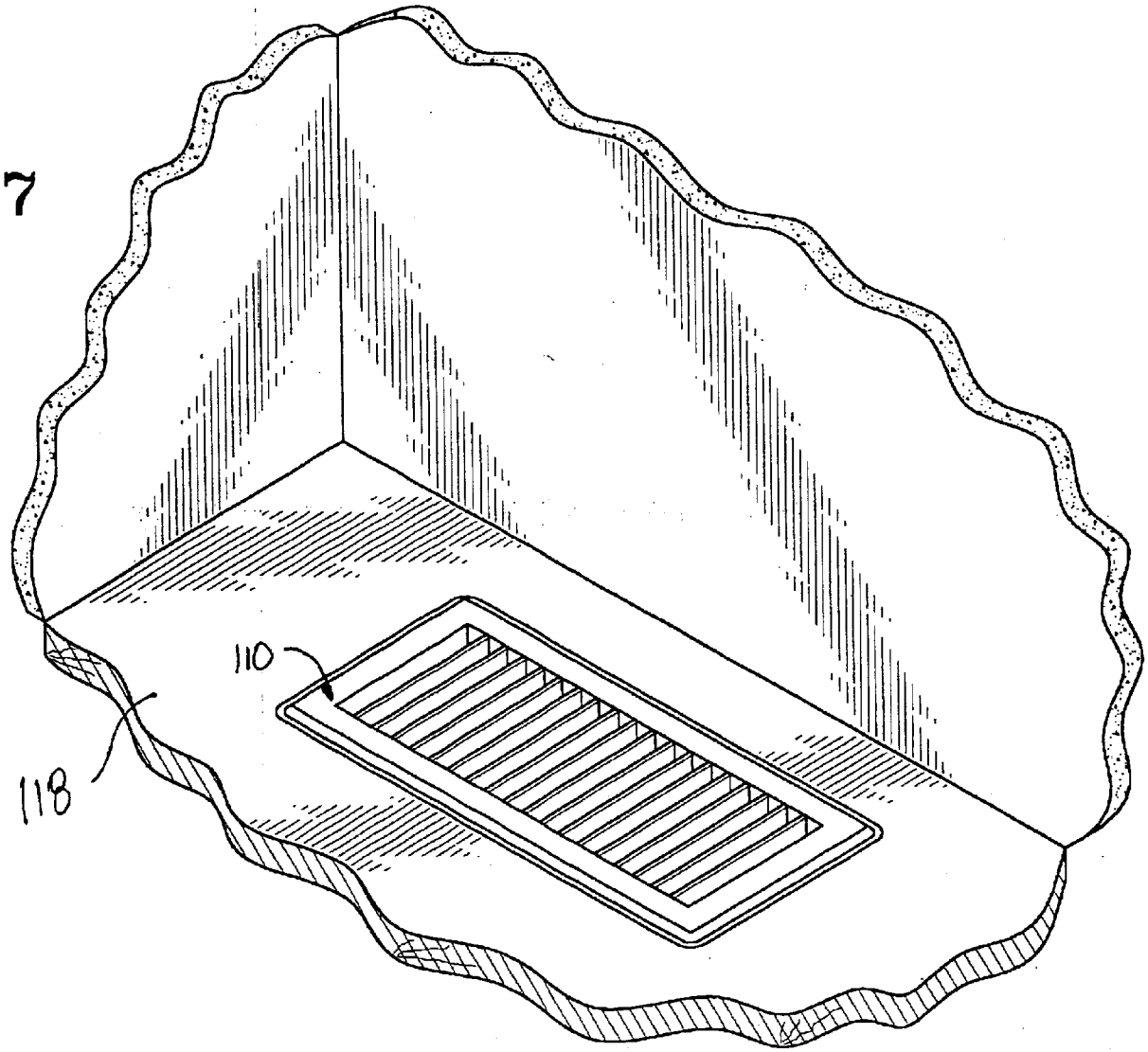
FIG. 27 is a perspective view showing the register disposed in the register opening.

Cover 100 is used by first forming openings 120 and 140 if needed. This step is depicted in FIG. 20. The user then positions body 112 of register vent 110 in body opening 140 as depicted in FIGS. 21 and 22. If desired, filter material 126 may be laid on top of flange 114. The user then removes cover 132 from adhesive 130 and folds upper layer 104 over lower layer 106 about living hinges 108 as depicted in FIG. 23. The user attaches the lengthwise edge of upper layer 104 to the lengthwise edge of lower layer 106 with adhesive 130. The covered register vent may then be installed in a register opening in floor 118 as depicted in FIGS. 24 and 25. Register vent 110 is thus well protected from scrapes, paint droppings, and damage during construction that occurs within the room having the register opening. When the construction is complete, the user removes the combination from the register opening and tears upper layer 104 from lower layer 106 as depicted in FIG. 26. The user then removes register vent 110 from cover 100 and discards cover 100. Register vent 110 may then be reinstalled in floor 118 as depicted in FIG. 27.

Figure 28:
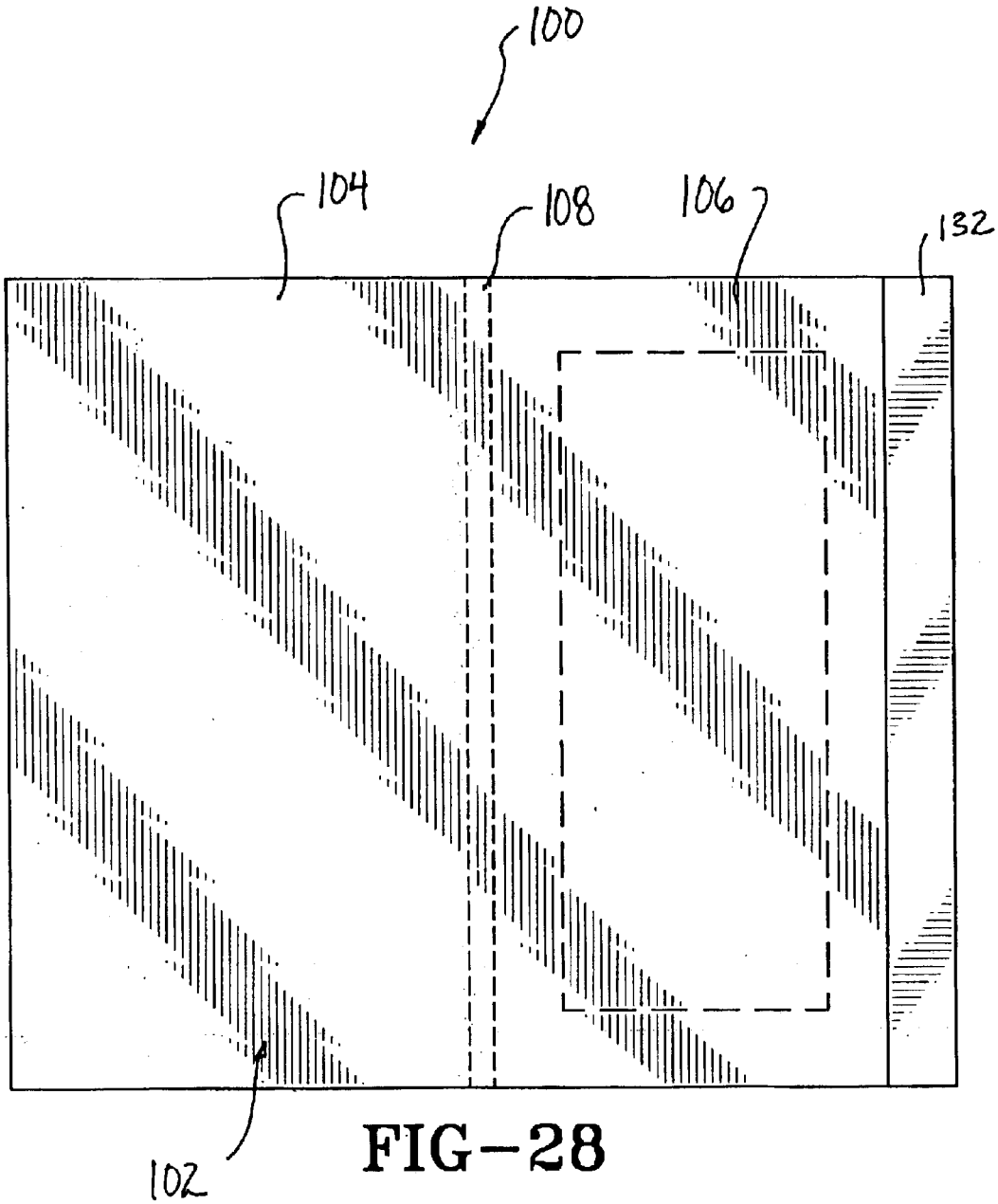
FIG. 28 is a top plan view of a fourth embodiment of the register opening cover of the present invention when the cover is in an unfolded condition.
Figure 29:
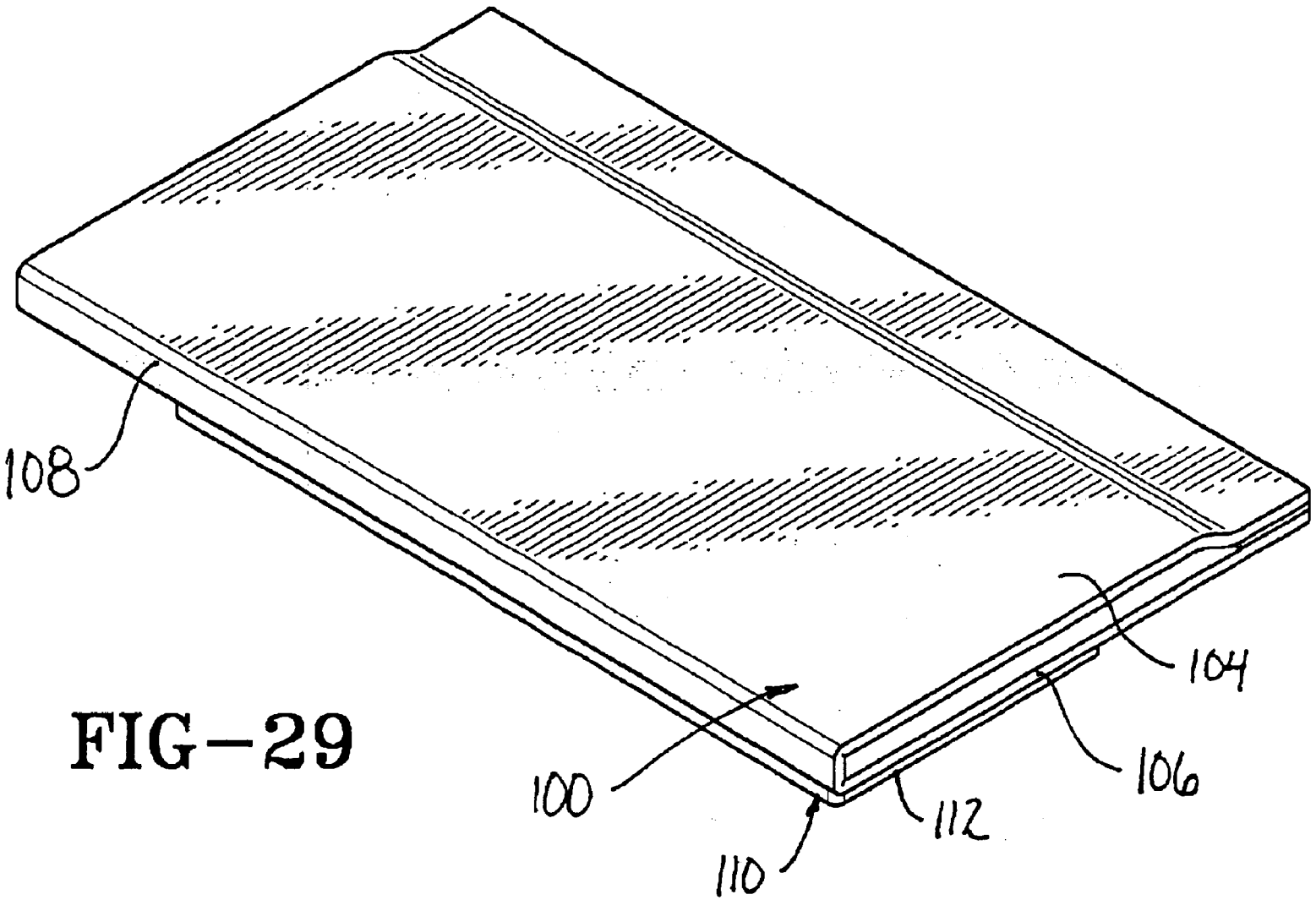
FIG. 29 is a perspective view of the fourth embodiment of the register opening cover disposed around a register.

FIGS. 28 and 29 depict a fourth embodiment of the register cover upper layer 104 is solid and not used with openings 120. This embodiment is preferred when air does not need to be circulated through the ventilating system of the building during construction. There is no need for filter 126 in this embodiment.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A register cover for a register opening in a floor; the register opening having a length and a width; the register cover comprising:

a body having an upper side and a lower side;

the body having a length and a width; the length of the body being adapted to be larger than the length of the register opening; the width of the body being adapted to be larger than the width of the register opening;

a pair of legs pivotally connected to the body;

each of the legs extending from the lower side of the body;

each of the legs pivoting between extended and retracted positions; and the legs being adapted to be inserted into the register opening when the legs are in the retracted position.

2. The register cover of claim 1, wherein each of the legs has outer edges; each of the edges being crenulated and adapted to engage the floor when the legs are disposed in the register opening.

3. The register cover of claim 1, wherein each of the legs has an inner end connected to the body and an outer end; the outer end of each leg having a width greater than the width of the inner end of each leg.

4. The register cover of claim 1, wherein the body includes upper and lower layers of body material.

5. The register cover of claim 4, wherein the upper and lower layers have first and second edges; the first edges being connected together with a living hinge.

6. The register cover of claim 5, wherein the upper and lower layers are fabricated from an extruded corrugated polymer.

7. The register cover of claim 5, wherein the second edges are connected together with an adhesive.

8. The register cover of claim 1, wherein the body is fabricated from a corrugated polymer.

9. The register cover of claim 1, wherein each of the legs is connected to the body with a plurality of spaced living hinges.

10. The register cover of claim 9, wherein the living hinges are disposed in the lengthwise direction of the body.

11. The register cover of claim 1, wherein each of the legs has an outer end; the distance between the outer ends of the legs when the legs are in the extended position being greater than the length of the body.

12. The register cover of claim 11, wherein each of the legs projects from the body in a direction substantially perpendicular to the lengthwise direction of the body.

13. The register cover of claim 1, wherein each of the legs has an outer end; the distance between the outer ends of the legs when the legs are in the extended position being greater than the width of the body.

14. The register cover of claim 13, wherein each of the legs projects from the body in a direction substantially perpendicular to the lengthwise direction of the body.

15. A protective register vent cover and a register vent that is used in a register opening defined by a floor; the combination comprising:

a register vent having a body adapted to be placed in the register opening defined by the floor; the body having an upper portion;

the register vent having a flange projecting from the upper portion of the body; the flange having a width and length larger than the width and length of the register opening;

a protective register vent cover having an upper layer and a lower layer connected together with a living hinge;

the lower layer defining a body opening;

the body of the register vent disposed in the body opening of the lower layer;

the upper layer of the cover being hinged to the lower layer with a living hinge; the upper layer having a length and a width greater than the width and length of the flange of the register vent;

the upper layer disposed over the flange; and the upper and lower layers being connected opposite the living hinge to hold the cover on the register vent.

16. The combination of claim 15, wherein the living hinge includes a pair of parallel living hinges.

17. The combination of claim 15, wherein the protective register vent cover is fabricated from a corrugated material.

18. The combination of claim 17, wherein the material is corrugated polymer.

19. The combination of claim 15, wherein the upper layer of the protective register vent cover includes markings that define an area that may be cut out by the user to form a vent opening.

20. The combination of claim 19, wherein the markings are perforations that allow the vent opening to be formed without cutting tools.

* * * * *